US009647308B2

(12) United States Patent
Sumiyosi et al.

(10) Patent No.: US 9,647,308 B2
(45) Date of Patent: May 9, 2017

(54) DIELECTRIC FILTER HAVING DIELECTRIC RESONATORS DISPOSED WITHIN A CASING AND SECURED BY AN INTERMEDIATE MEMBER

(71) Applicant: Nokia Solutions and Networks Oy, Espoo (FI)

(72) Inventors: Takasi Sumiyosi, Kadoma (JP); Minoru Tachibana, Kadoma (JP); Masayuki Oki, Kawasaki (JP)

(73) Assignee: Nokia Solutions and Networks Oy, Espoo (FI)

( * ) Notice: Subject to any disclaimer, the term of this patent is extended or adjusted under 35 U.S.C. 154(b) by 107 days.

(21) Appl. No.: 14/421,165

(22) PCT Filed: Aug. 12, 2013

(86) PCT No.: PCT/JP2013/004831

§ 371 (c)(1),
(2) Date: Jun. 2, 2015

(87) PCT Pub. No.: WO2014/027461

PCT Pub. Date: Feb. 20, 2014

(65) Prior Publication Data

US 2015/0263402 A1 Sep. 17, 2015

(30) Foreign Application Priority Data

Aug. 13, 2012 (JP) ..... 2012-179284

(51) Int. Cl.

| | |
|---|---|
| ***H01P 1/20*** | (2006.01) |
| ***H01P 1/208*** | (2006.01) |
| ***H01P 7/10*** | (2006.01) |

(52) U.S. Cl.
CPC ..... *H01P 1/2084* (2013.01); *H01P 7/10* (2013.01)

(58) Field of Classification Search
CPC ..... H01P 1/2084; H01P 1/2086; H01P 7/10
USPC ..... 333/202, 219.1
See application file for complete search history.

(56) References Cited

U.S. PATENT DOCUMENTS

| | | | | |
|---|---|---|---|---|
| 6,320,484 | B1 * | 11/2001 | Furuya et al. | H01P 7/10 333/202 |
| 2005/0030131 | A1 | 2/2005 | Yamakawa et al. | |
| 2010/0308937 | A1 | 12/2010 | Myllyvainio et al. | |
| 2011/0070860 | A1 * | 3/2011 | Schon | H01P 1/2084 455/347 |

(Continued)

FOREIGN PATENT DOCUMENTS

| | | |
|---|---|---|
| CN | 201673988 U | 12/2010 |
| CN | 102113168 A | 6/2011 |

(Continued)

*Primary Examiner* — Benny Lee
(74) *Attorney, Agent, or Firm* — Harrington & Smith

(57) ABSTRACT

Provided is a dielectric filter that can be anchored in a stable manner without causing damage even when there is variation in the size of the parts. With this dielectric filter, one surface of washers has a concave part, which is equipped with an edge part formed at the perimeter of the one surface, a floor surface provided at a lower position than the edge part, and a tapered part formed between the edge part and the floor surface. The washers are arranged on the upper surface of and fastened by means of screws to dielectric bodies with the concave parts facing the dielectric bodies, with sheet metal therebetween.

15 Claims, 9 Drawing Sheets

(56) References Cited

U.S. PATENT DOCUMENTS

| | | | | |
|---|---|---|---|---|
| 2011/0128097 | A1* | 6/2011 | Park et al. | H01P 7/10 333/219.1 |
| 2013/0176088 | A1* | 7/2013 | Mao et al. | H01P 7/10 333/202 |

FOREIGN PATENT DOCUMENTS

| | | | |
|---|---|---|---|
| CN | 202004138 | U | 10/2011 |
| CN | 102509826 | A | 6/2012 |
| CN | 202308237 | U | 7/2012 |
| EP | 1 505 687 | A1 | 2/2005 |
| JP | 06-034307 | | 2/1994 |
| JP | 07-066611 | | 3/1995 |
| JP | 2000-165118 | | 6/2000 |
| JP | 2005-073242 | | 3/2005 |
| JP | 2005-223665 | A | 8/2005 |
| JP | 2011-529666 | A | 12/2011 |

* cited by examiner

DIELECTRIC FILTER HAVING DIELECTRIC RESONATORS DISPOSED WITHIN A CASING AND SECURED BY AN INTERMEDIATE MEMBER

TECHNICAL FIELD

The present invention relates to a TM mode dielectric filter.

BACKGROUND ART

Base stations and mobile stations in a mobile communication system are each provided with a filter to suppress an unnecessary wave other than a desired wave when transmitting and/or receiving a radio signal. A dielectric filter is often used for this filter.

The filter on the base station is required to reduce passband loss. Reducing passband loss requires a dielectric having a high Q value, but a reduction of passband loss using a general TE mode dielectric filter would result in an increase in size. Thus, a TM mode dielectric filter which has a lower Q value than the TE mode but can be downsized has been attracting attention in recent years (e.g., see the Citation List for PTLs 1 to 5 listed below).

For the TM mode dielectric filter, upper and lower surfaces of the dielectric need to be shielded based on the principles of the TM mode dielectric filter. For this reason, PTL 1, or the like, discloses a technique for fixing the dielectric in place while shielding the upper and lower surfaces of the dielectric.

As shown in FIG. 1, PTL 1 discloses a technique for firmly fixing dielectric resonator 2 to metal case 1 in a longitudinal direction and a vertical direction of the resonator using resonator fixing plate 3 and spacer 6. Connectors 30 are mounted on both ends of the metal case 1. It is thereby possible to provide a TM mode dielectric filter that remains stable under vibration or impact. PTL 1 corresponds to U.S. Pat. No. 6,320,484 to Furuya et al.

CITATION LIST

Patent Literature

PTL 1
Japanese Patent Application Laid-Open No. 2000-165118
PTL 2
Japanese Patent Application Laid-Open No. 7-66611
PTL 3
Japanese Utility Model (Registration) Application Laid-Open No. 6-34307
PTL 4
Japanese Unexamined Patent Application Publication (Translation of PCT Application) No. 2011-529666
PTL 5
Japanese Patent Application Laid-Open No. 2005-223665

SUMMARY OF THE INVENTION

Technical Problem

However, the TM mode dielectric filter described in PTL 1 has a fixing structure in which a sheet metal is sandwiched between a cover and a dielectric, and the dielectric resonator is fixed in place by the sizes of components such as the cover, dielectric, sheet metal. For this reason, if there is a variation in the sizes of the components, the fixing may become unstable or an excessive pressure may be applied to the dielectric, causing damage or the like to the dielectric.

An object of the present invention is to provide a dielectric filter stably fixed without damage even when there is a variation in the size of the components.

Solution to the Problem

A dielectric filter according to an aspect of the present invention includes at least one resonator using a TM mode, in which the resonator includes at least the following elements (1) to (4):

(1) a three-dimensionally shaped dielectric that includes a first surface and a second surface opposite to the first surface;

(2) a case that includes a first inner surface and a second inner surface facing the first inner surface and that accommodates the dielectric so that the first surface faces the first inner surface while the second surface faces the second inner surface;

(3) an intermediate member that is disposed between the first inner surface and the first surface and that is movable at least in a direction from the first inner surface toward the second inner surface; and (4) a pressing member that is capable of pressing the intermediate member in a direction from the first inner surface toward the second inner surface.

Advantageous Effects of the Invention

According to an aspect of the present invention, it is possible to provide a dielectric filter stably fixed without damage even when there is a variation in size of components.

DETAILED DESCRIPTION OF THE PREFERRED EMBODIMENTS

Figure 1:
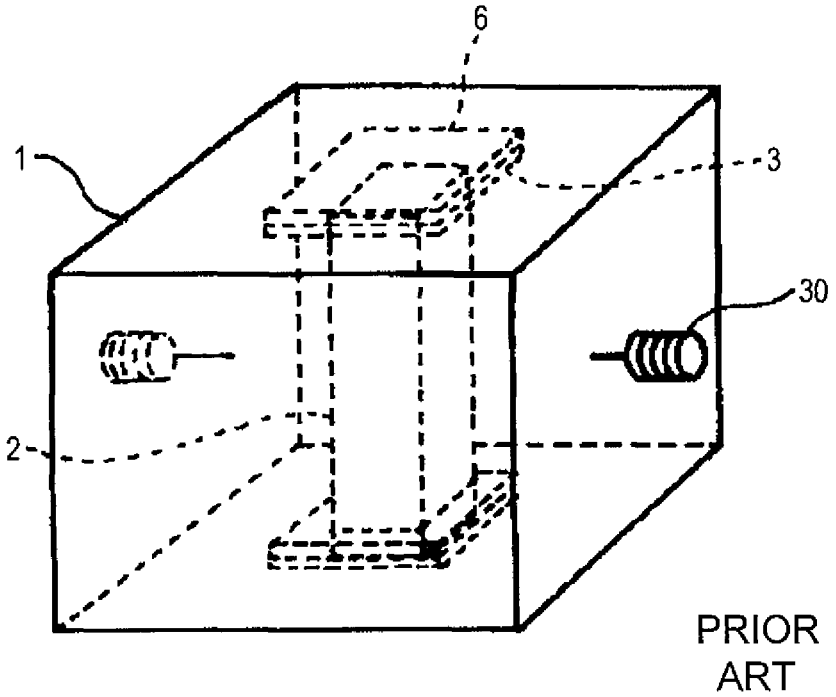
FIG. 1 illustrates a configuration of a prior art dielectric filter disclosed in PTL 1.

Hereinafter, each embodiment of the present invention will be described in detail with reference to the accompanying drawings. Throughout the embodiments, the same components are assigned the same reference numerals and the overlapping description thereof will be omitted, however.

Embodiment

[Configuration of Dielectric Filter]

Figure 2:
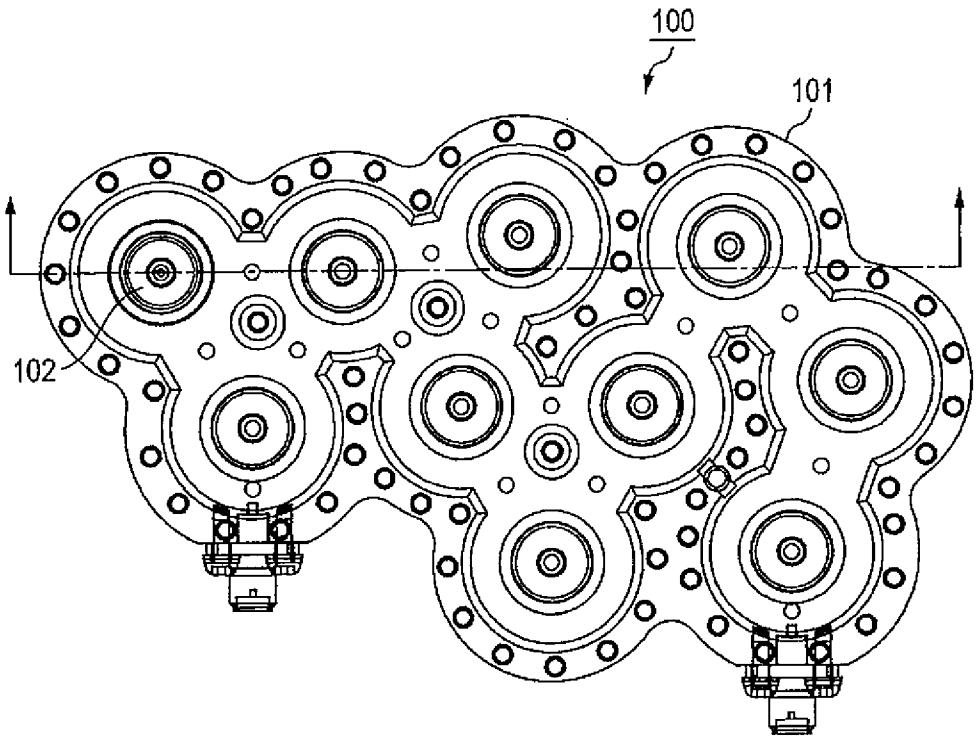
FIG. 2 is a top view illustrating an overall TM mode dielectric filter according to an embodiment of the present invention.
Figure 3:
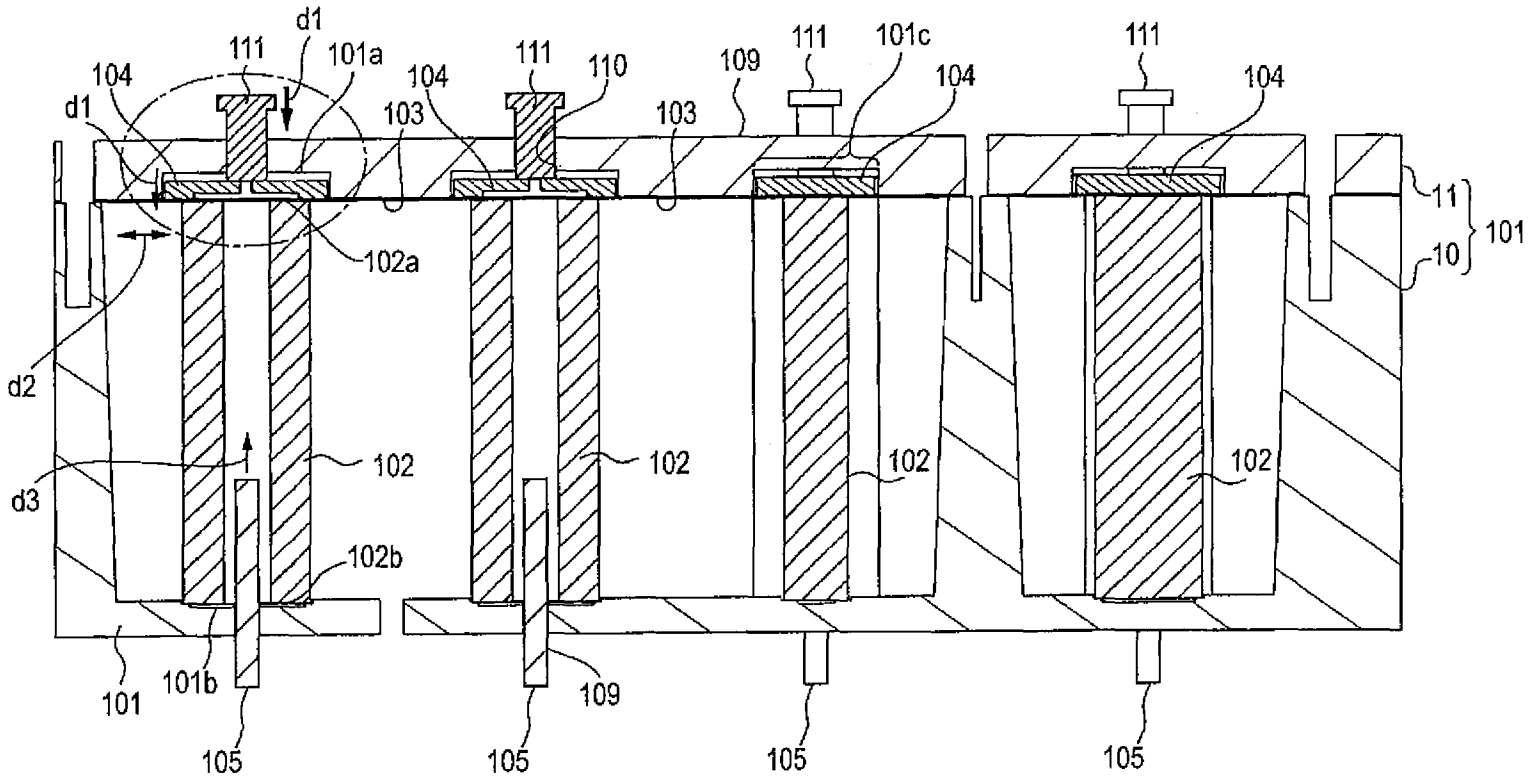
FIG. 3 is a cross-sectional view of the overall dielectric filter in FIG. 2.
Figure 4:
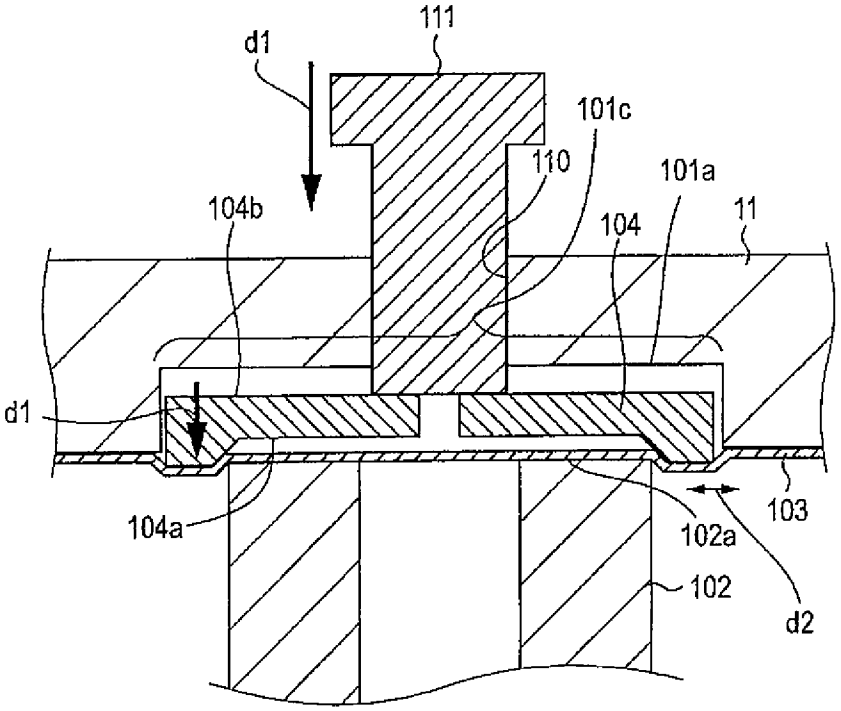
FIG. 4 is an enlarged view of the region enclosed by the ellipse in FIG. 3.

FIG. 2 is a top view illustrating overall TM mode dielectric filter (hereinafter simply referred to as "dielectric filter") 100 according to an embodiment of the present invention, FIG. 3 is a cross-sectional view of overall dielectric filter 100 in FIG. 2 and FIG. 4 is an enlarged view of the region enclosed by the ellipse in FIG. 3. However, FIG. 2 shows the dielectric filter without a cover 11. FIG. 3 and FIG. 4 show a situation in which screw 111 is inserted into cover 11.

Dielectric filter 100 is provided with at least one resonator using a TM mode. For example, dielectric filter 100 shown in FIG. 2 is provided with ten resonators. Each resonator is provided with at least case 101, dielectric 102, washer 104 (FIGS. 3 and 4) serving as an intermediate member, screw 111 (FIGS. 3 and 4) serving as a pressing member and frequency adjusting screw 105 (FIG. 3).

More specifically, case 101 is formed of side and bottom surfaces and provided with case 10 whose one side (top surface in FIG. 3) is open and cover 11 that covers the open surface of case 10.

Case 101 also includes inner surface 101*a* (first inner surface) and inner surface 101*b* (second inner surface) opposite to inner surface 101*a* as shown in FIG. 3. That is, in FIG. 3, cover 11 is at least part of case 101 and includes inner surface 101*a*. Case 10 includes inner surface 101*b*.

In FIG. 3 and FIG. 4, case 101 (FIG. 3) includes regulation section 101*c* that regulates the movement of washer 104 along direction d2 (FIG. 3) which is parallel to inner surface 101*a*. For example, regulation section 101*c* is a recessed portion provided in inner surface 101*a* of cover 11 having a size corresponding to an outer shape of washer 104.

Dielectric 102 is a three-dimensionally shaped dielectric that includes surface 102*a* (first surface) and surface 102*b* (second surface) as shown in FIG. 3 opposite to surface 102*a*. For example, dielectric 102 has a columnar shape, and surface 102*a* and surface 102*b* are columnar end faces.

As shown in FIG. 3, dielectric 102 is accommodated in case 101 with surface 102*a* facing inner surface 101*a*, and surface 102*b* facing inner surface 101*b*.

Washer 104 is disposed between inner surface 101*a* of case 101 and surface 102*a* of dielectric 102 and is movable at least in direction d1 from inner surface 101*a* toward inner surface 102*b*.

Screw 111 can press washer 104 in direction d1 from inner surface 101*a* toward inner surface 101*b*. For example, when screw hole 110 is provided in inner surface 101*a* of case 101 and a female thread is formed in screw hole 110 in a direction from inner surface 101*a* toward inner surface 101*b*, screw 111 is a male screw that is inserted into the above female thread.

Frequency adjusting screw 105 adjusts a resonance frequency. More specifically, as shown in FIG. 3, screw hole 109 is provided at a position facing surface 102*b* of dielectric 102 at the bottom of case 10, and frequency adjusting screw 105 is inserted into screw hole 109 and thereby protrudes in direction d3 from inner surface 101*b* toward inner surface 101*a* of case 11. The resonance frequency is adjusted by changing the length of frequency adjusting screw 105 protruding from inner surface 101*b* toward inner surface 101*a* of case 11.

As shown in FIG. 2, in dielectric filter 100, a plurality of columnar dielectrics 102 are arranged vertically at predetermined positions at appropriate intervals inside case 101. As shown in FIG. 4, the open surface of case 101 (FIG. 3) is covered with sheet metal 103. That is, sheet metal 103 is disposed along inner surface 101*a* inside case 101 and between washer 104 and surface 102*a* of dielectric 102. Furthermore, as shown in FIG. 2, in dielectric filter 100 provided with at least two resonators arranged in parallel, sheet metals 103 (FIGS. 3 and 4) for the at least two resonators are integrated into one piece. Sheet metal 103 serves as the ground for each dielectric 102 and contributes to ground reinforcement.

[Structure of Washer 104]

Figure 5A:
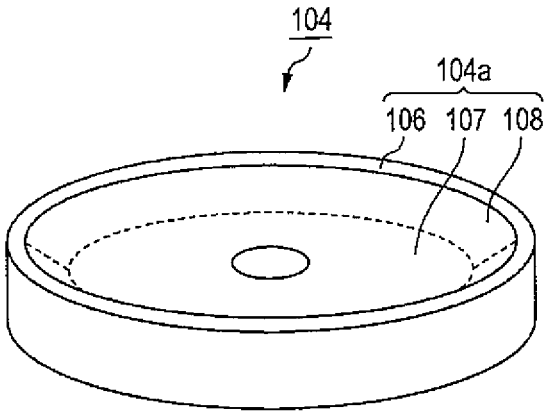
FIG. 5A is a perspective view illustrating a configuration of a washer.
Figure 5B:
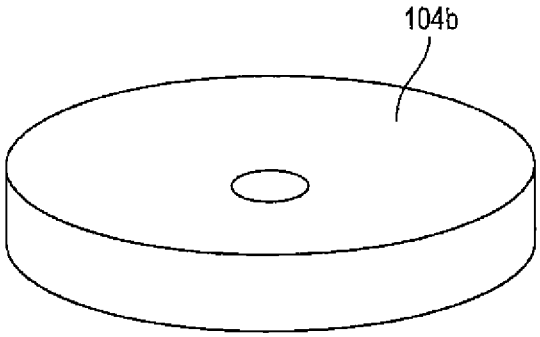
FIG. 5B is a perspective view illustrating a configuration of a washer.

As shown in FIG. 4, washer 104 is disposed above surface 102*a* of dielectric 102 with sheet metal 103 interposed in between. For example, as shown in FIG. 4, washer 104 has a planar shape including a facing surface (surface 104*a*) facing surface 102*a* of dielectric 102 and surface 104*b* opposite to surface 104*a* (FIG. 5A and FIG. 5B). Furthermore, washer 104 has a recessed portion in the facing surface (surface 104*a*).

For example, as shown in FIG. 4, FIG. 5A and FIG. 5B, washer 104 (FIGS. 4 and 5A) has a recessed portion having a size corresponding to the outer shape of surface 102*a* of dielectric 102 in surface 104*a* and the recessed portion is disposed so as to be fitted to surface 102*a* of dielectric 102. More specifically, as shown in FIG. 5A, the recessed portion of surface 104*a* includes bottom surface 107 provided at a position recessed by a predetermined thickness from the circumference of surface 104*a* in the direction of surface 104*b*, and tapered portion 108 which is formed in a tapered shape between the circumference of surface 104*a* and bottom surface 107. Surface 104*a* of washer 104 has edge portion 106 around the circumference of the recessed portion of surface 104*a*. That is, in FIG. 5A, washer 104 is provided with bottom surface 107 provided at a position one step recessed (corresponding to a predetermined thickness) from edge portion 106, and tapered portion 108 which is formed in a tapered shape between edge portion 106 and bottom surface 107. Washer 104 shown in FIG. 5A and FIG. 5B serves as a position regulating member with respect to the d2 (FIGS. 3 and 4) direction of dielectric 102.

[Operation of Dielectric Filter 100]

As described above with respect to FIG. 2, cover 11 that covers sheet metal 103 and washer 104 is placed over the open surface of case 10. Cover 11 is provided with screw hole 110 at a position facing washer 104, and screw 111 is screwed into screw hole 110.

In dielectric filter 100 having such a configuration, when screw 111, inserted into screw hole 110, is turned clockwise by a predetermined amount, the distal end of screw 111 comes into contact with surface 104*b* of washer 104. When screw 111 is turned further, screw 111 presses washer 104 in a direction from inner surface 101*a* toward inner surface 101*b* of case 101. Dielectric 102 can be fixed with the pressure with which screw 111 presses washer 104. By so doing, even when there is a variation in size of components of each resonator, it is possible to add a pressure on the same (constant) level to dielectrics 102 of all resonators of dielectric filter 100 equally by appropriately performing torque management (that is, adjustment of the amount of rotation of screw 111) using screw 111 provided for each resonator for dielectrics 102 of all the resonators in dielectric filter 100. It is also possible to prevent more than necessary pressure from being imposed on each dielectric 102 and prevent damage to dielectric 102.

Therefore, according to the present embodiment, even when there is a variation in the size of the components, it is possible to realize a dielectric filter stably fixed without damage.

Dielectric filter 100 is provided with screw 111 which is inserted into screw hole 110 provided in inner surface 101*a* of case 101, and screw 105 which is inserted into screw hole 109 provided in inner surface 101*b* of case 101. That is, in dielectric filter 100, it is possible to appropriately fix each dielectric 102 using screw 111 provided separately from frequency adjusting screw 105.

[Operation of Washer 104]

In FIG. 4, edge portion 106 (FIG. 5A) of washer 104 presses sheet metal 103, which applies a pressure to dielectric 102 and causes tapered portion 108 to come into line-contact with the circumference of surface 102*a* of dielectric 102, making it possible to reduce contact variations and stably fix dielectric 102. When screw 111 is inserted, performing torque management can prevent more than necessary pressure from being applied to dielectric 102 and prevent damage to dielectric 102.

Thus, dielectric filter 100 according to the present embodiment includes, on one side of washer 104, recessed portion 105 provided with edge portion 106 formed around the circumference of the one side, bottom surface 107 (FIG. 5A) provided at a position one step recessed from edge portion 106, and tapered portion 108 formed in a tapered shape between edge portion 106 and bottom surface 107, wherein washer 104 is disposed so that recessed portion 105 is positioned opposite to surface 102*a* of dielectric 102 with sheet metal 103 interposed in between, and washer 104 is screwed by screw 111.

In this way, edge portion 106 of washer 104 presses sheet metal 103, tapered portion 108 (FIG. 5A) comes into line-contact with the circumference of surface 102*a* of dielectric 102, a pressure is applied to dielectric 102, and dielectric 102 can be stably fixed. Moreover, threaded engagement of screw 111 under torque management can prevent more than necessary pressure from being applied to dielectric 102 to prevent damage to dielectric 102. As a result, even when there is a variation in size of components, it is possible to stably fix dielectric 102 without damage.

Note that sheet metal 103 is not essential in stably fixing dielectric 102.

Other Embodiments

The configuration shown in FIG. 4 has been described in the present embodiment, but the present invention is not limited to this. Hereinafter, configurations 1 to 4 other than the configuration described above will be described using FIG. 6 to FIG. 9.

Figure 6:
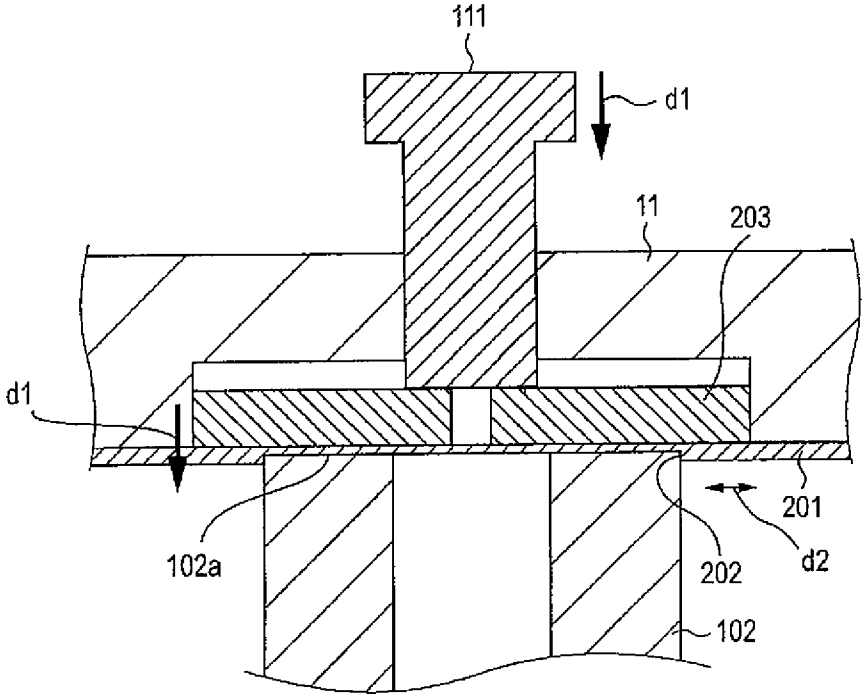
FIG. 6 is a cross-sectional view illustrating configuration 1, which is another configuration of the dielectric filter according to the embodiment of the present invention.

FIG. 6 is a cross-sectional view illustrating configuration 1, which is another configuration of the dielectric filter according to the embodiment of the present invention. Sheet metal 201 is provided with recessed portion 202 having a size corresponding to the outer shape of surface 102*a* of dielectric 102 at a position overlapping with surface 102*a* of dielectric 102. When sheet metal 201 is attached to case 101 and fixed to case 101 (not shown herein), recessed portion 202 provided in sheet metal 201 is fitted to surface 102*a* of dielectric 102, which causes sheet metal 201 provided with recessed portion 202 to serve as a position regulating member in the d2 direction of dielectric 102. Washer 203 (flat washer) is disposed on surface 102*a* of dielectric 102 with sheet metal 201 interposed in between.

Figure 7:
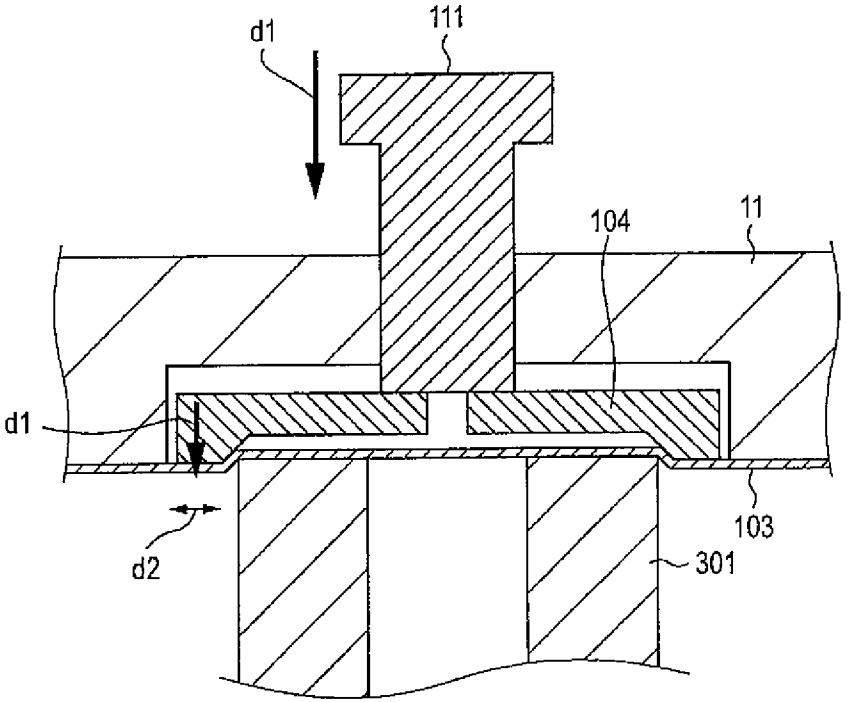
FIG. 7 is a cross-sectional view illustrating configuration 2, which is another configuration of the dielectric filter according to the embodiment of the present invention.

FIG. 7 is a cross-sectional view illustrating configuration 2, which is another configuration of the dielectric filter according to the embodiment of the present invention. The length of dielectric 301 used here is greater than the height of the side wall of case 10 (not shown herein) so that, when screw 111 is inserted, a pressure is applied from dielectric 301.

Figure 8:
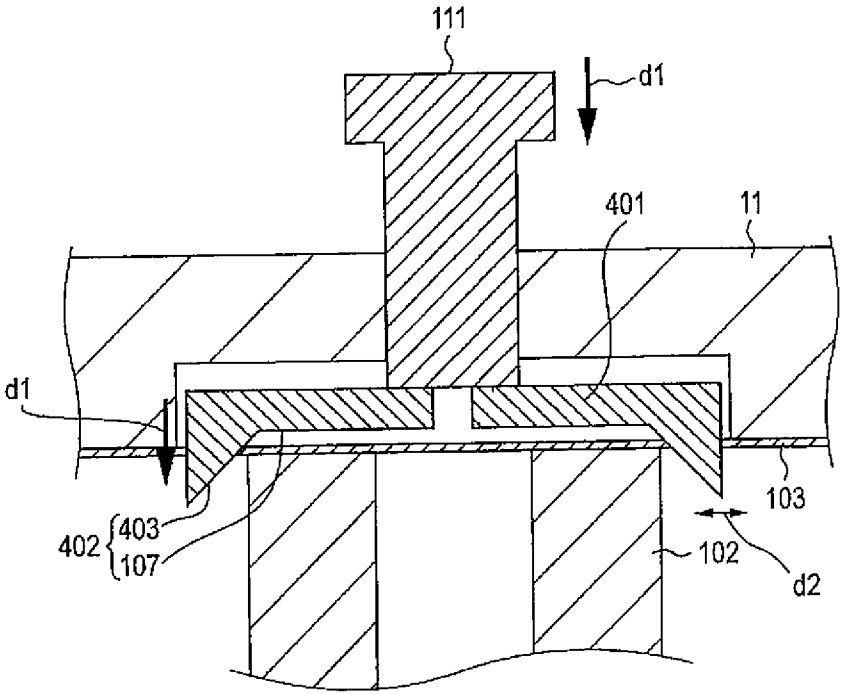
FIG. 8 is a cross-sectional view illustrating other configuration 3, which is another configuration of the dielectric filter according to the embodiment of the present invention.

FIG. 8 is a cross-sectional view illustrating configuration 3, which is another configuration of the dielectric filter according to the embodiment of the present invention. No edge portion is provided in recessed portion 402 of washer 401 and tapered portion 403 is formed on bottom surface 107 from the circumference of washer 401. Washer 401 having such a shape is disposed on surface 102*a* (not shown herein) of dielectric 102 with sheet metal 401 interposed in between, screw 111, inserted into screw hole 110, is turned by a predetermined amount to press washer 401, tapered portion 403 of washer 401 thereby penetrates sheet metal 103 causing tapered portion 403 to come into line-contact with the circumference of surface 102*a* of dielectric 102.

Figure 9:
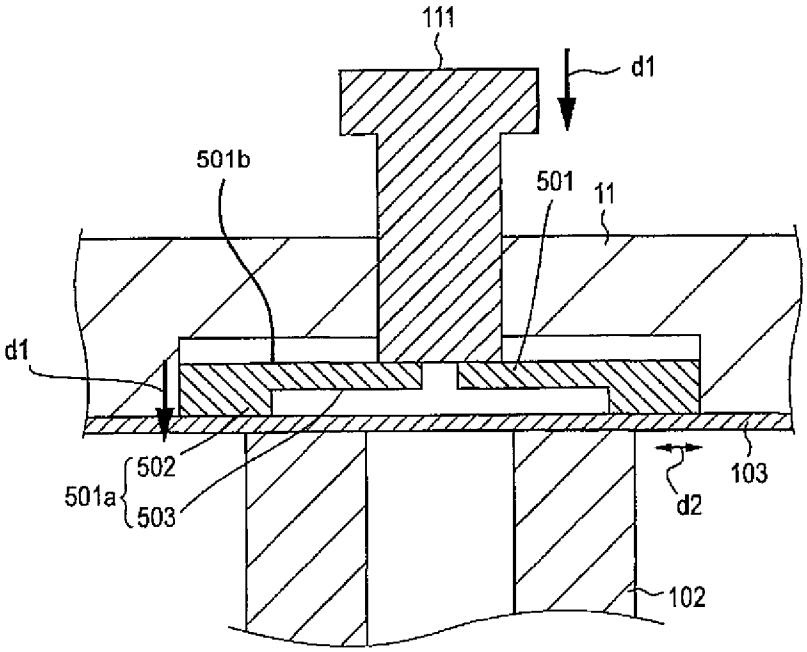
FIG. 9 is a cross-sectional view illustrating configuration 4, which is another configuration of the dielectric filter according to the embodiment of the present invention.

FIG. 9 is a cross-sectional view illustrating configuration 4, which is another configuration of the dielectric filter according to the embodiment of the present invention. Washer 501 has a planar shape including surface 501*a* facing surface 102*a* (not shown herein) of dielectric 102 and surface 501*b* opposite to surface 501*a*. Surface 501*a* of washer 501 is provided with recessed portion 503 including edge portion 502 that contacts (overlaps with) the circumference of dielectric 102 (surface 102*a*) via sheet metal 103 and bottom surface 503 provided at a position recessed by a predetermined thickness from edge portion 502 (circumference of surface 501*a*) in the direction of surface 501*b*. In the resonator, a current flows over the side face of dielectric 102, so that, when current loss is taken into consideration, the angle formed by the side face of dielectric 102 and surface 501*a* of washer 501 is preferably a right angle. In other words, since no current flows through the inside of dielectric 102, recessed portion 503 may be formed in the portion of dielectric 102 other than the circumference of dielectric 102, without surface 501 of washer 501 being brought into contact via sheet metal 103.

A case has been described in the above embodiment where the hollow part penetrates the portion between surface 102*a* and surface 102*b* of dielectric 102 in FIG. 3, but the present invention is not limited to this configuration. For example, dielectric 102 may also have a recessed portion open toward inner surface 101*b* of case 10 (not shown). In this case, frequency screw 105 is inserted into screw hole 109 and thereby protrudes from inner surface 101*b* of case 10 toward the recessed portion of dielectric 102.

A case has been described in the above embodiment where a screw is used as the pressing member. However, the pressing member is not limited to a screw, and any member may be used as long as the member can press the intermediate member in a direction from inner surface 101*a* of case 101 toward inner surface 101*b*. For example, a spring may be used as the pressing member instead of a screw.

The disclosure of Japanese Patent Application No. 2012-179284, filed on Aug. 13, 2012, including the specification, drawings and abstract is incorporated herein by reference in its entirety.

INDUSTRIAL APPLICABILITY

The dielectric filter according to the present invention is applicable to a base station apparatus and the like in a mobile communication system, for example.

REFERENCE SIGNS LIST

100, 101 Case
102, 301 Dielectric
103, 201 Sheet metal
104, 203, 401, 501 Washer (intermediate member)
105 Frequency adjusting screw
106, 502 Edge portion
107 Bottom surface
108, 403 Tapered portion
11 Cover
109, 110 Screw hole
111 Screw (pressing member)

The invention claimed is:

1. A dielectric filter comprising at least one resonator using a TM mode, wherein the at least one resonator includes:

a three-dimensionally shaped dielectric including a first surface and a second surface opposite to the first surface;

a case including a first inner surface and a second inner surface facing the first inner surface, said case accommodating the dielectric so that the first surface faces the first inner surface while the second surface faces the second inner surface;

an intermediate member disposed between the first inner surface and the first surface, said intermediate member being movable at least in a direction from the first inner surface toward the second inner surface; and a pressing member capable of pressing the intermediate member in a direction from the first inner surface toward the second inner surface, wherein the intermediate member includes a facing surface that faces the first surface, and a recessed portion in the facing surface, the facing surface including an edge portion at a circumference portion of the recessed portion of the facing surface.

2. A dielectric filter comprising at least one resonator using a TM mode, wherein the at least one resonator includes:

a three-dimensionally shaped dielectric including a first surface and a second surface opposite to the first surface;

a case including a first inner surface and a second inner surface facing the first inner surface, said case accommodating the dielectric so that the first surface faces the first inner surface while the second surface faces the second inner surface;

an intermediate member disposed between the first inner surface and the first surface, said intermediate member being movable at least in a direction from the first inner surface toward the second inner surface;

a pressing member capable of pressing the intermediate member in a direction from the first inner surface toward the second inner surface; and a sheet metal disposed inside the case, and separating the first inner surface and the intermediate member from the first surface of the dielectric.

3. A dielectric filter comprising at least one resonator using a TM mode, wherein the at least one resonator includes:

a three-dimensionally shaped dielectric including a first surface and a second surface opposite to the first surface;

a case including a first inner surface and a second inner surface facing the first inner surface, said case accommodating and the dielectric so that the first surface faces the first inner surface while the second surface faces the second inner surface;

an intermediate member disposed between the first inner surface and the first surface, said intermediate member being movable at least in a direction from the first inner surface toward the second inner surface; and a pressing member capable of pressing the intermediate member in a direction from the first inner surface toward the second inner surface, wherein the case includes a regulation section for regulating movement of the intermediate member along a direction parallel to the first inner surface, the regulation section being a recessed portion provided in the first inner surface, said recessed portion having a shape with a size corresponding to an outer shape of the intermediate member.

4. The dielectric filter according to claim 3, wherein the case includes a screw hole in the first inner surface, the screw hole being female-threaded to form a female thread along a direction from the first inner surface toward the second inner surface, and the pressing member is a male screw inserted into the female thread.

5. The dielectric filter according to claim 3, wherein the dielectric has a columnar shape, and the first surface and the second surface are end surfaces of the columnar shape, respectively.

6. The dielectric filter according to claim 3, wherein at least a part of the case is a cover that has the first inner surface.

7. The dielectric filter according to claim 3, wherein the intermediate member includes:

a facing surface that faces the first surface; and a recessed portion in the facing surface.

8. The dielectric filter according to claim 7, wherein the recessed portion of the facing surface includes:

a bottom surface provided at a position recessed by a predetermined amount from the facing surface within a circumference of the facing surface; and a tapered portion formed in a tapered shape between the circumference and the bottom surface.

9. The dielectric filter according to claim 7, wherein the facing surface includes an edge portion at a circumference portion of the recessed portion of the facing surface.

10. The dielectric filter according to claim 9, wherein the recessed portion of the facing surface has a size corresponding to an outer shape of the first surface and is capable of being fitted to the first surface.

11. The dielectric filter according to claim 3, wherein the intermediate member is a washer.

12. The dielectric filter according to claim 3, wherein the dielectric includes a recessed portion that is open toward the second inner surface, and the resonator includes a frequency adjusting screw that protrudes from the second inner surface toward the recessed portion of the dielectric.

13. The dielectric filter according to claim 3, further comprising a sheet metal disposed inside the case, and separating the first inner surface and the intermediate member from the first surface of the dielectric.

14. The dielectric filter according to claim 13, wherein the sheet metal includes a recessed portion corresponding to an outer shape of the first surface.

15. The dielectric filter according to claim 13, wherein the at least one resonator comprises two resonators disposed in parallel to one another, wherein the sheet metal is one continuous piece.

* * * * *